US007870907B2

(12) United States Patent
Lembcke et al.

(10) Patent No.: US 7,870,907 B2
(45) Date of Patent: Jan. 18, 2011

(54) DEBRIS PROTECTION FOR SLIDING SLEEVE

(75) Inventors: Jeffrey Lembcke, Cypress, TX (US); Joe Jordan, Willis, TX (US); Robert Coon, Missouri City, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 491 days.

(21) Appl. No.: 11/683,848

(22) Filed: Mar. 8, 2007

(65) Prior Publication Data

US 2008/0217021 A1 Sep. 11, 2008

(51) Int. Cl.
*E21B 34/00* (2006.01)

(52) U.S. Cl. ..... 166/334.4; 166/316

(58) Field of Classification Search ..... 166/334.4, 166/316

See application file for complete search history.

(56) References Cited

U.S. PATENT DOCUMENTS 3,390,724 A * 7/1968 Caldwell ..... 166/100
4,880,059 A 11/1989 Brandell et al.
4,949,788 A 8/1990 Szarka et al.
5,337,808 A 8/1994 Graham
5,425,424 A * 6/1995 Reinhardt et al. ..... 166/291
2006/0124310 A1 6/2006 Lopez de Cardenas et al.
2006/0272807 A1 * 12/2006 Adam et al. ..... 166/207

FOREIGN PATENT DOCUMENTS

WO 2008004876 A1 1/2008

OTHER PUBLICATIONS

European Search Report dated May 22, 2008 regarding European Application No. 08250525.6.

* cited by examiner

*Primary Examiner*—Daniel P Stephenson
*Assistant Examiner*—Brad Harcourt
(74) *Attorney, Agent, or Firm*—Wong, Cabello, Lutsch, Rutherford & Brucculeri, L.L.P.

(57) ABSTRACT

Sliding sleeve mechanisms including protective sheaths for debris protection are disclosed. Protective sheaths can be formed from materials such as composites, metal, foil, rubber, plastic, glass, ceramic, wire mesh, tape, etc. The protective sheaths can be substantially cylindrical shells (having one or more pieces), plugs in the flow ports, and/or tape or wire wrappings. The protective sheaths can be retained by recesses in the sliding sleeve or mechanical fasteners such as screws, pins, rivets, snap rings, bands, and buckles. The protective sheath can be outside or inside the sliding sleeve. The protective sheath can protect the sliding sleeve from debris by retaining grease that has been packed into the sliding sleeve for that purpose or positively preventing entry of debris into the sliding sleeve. The protective sheath can be cleared by permitting fluid flow through the sliding sleeve, which can act to destroy and/or wash away the protective sheath.

13 Claims, 2 Drawing Sheets

DEBRIS PROTECTION FOR SLIDING SLEEVE

BACKGROUND

Sliding sleeves are widely used in a variety of hydrocarbon production systems. A sliding sleeve typically includes a tubular outer housing having threaded connections at one or both ends for connection to a tubing string. The outer housing also includes one or more flow ports therethrough. Inside the housing, a sleeve mechanism is arranged to slide longitudinally within the outer housing. The sleeve may have one or more flow ports therethrough. The sleeve mechanism can be positioned to align the flow ports in the sleeve with the flow ports in the housing, which will allow fluid flow (either from inside out or outside in). Alternatively, the sleeve mechanism can be positioned so that the flow ports are not aligned, thereby preventing fluid flow. Many variations of this basic concept are known to those skilled in the art, and will not be discussed in detail here. For example, in some embodiments, the sleeve may not have flow ports, but may be arranged to either block the flow ports in the outer housing or not, thereby permitting flow or not.

In many applications, multiple sliding sleeves are used along a tubing string so that a hydrocarbon well can be segmented into a plurality of zones. By opening and/or closing various sliding sleeves, the individual zones can be isolated so that one or more zones can be produced, stimulated, etc. One example of such applications relates to multi-zone fracture systems, which are used, for example, in the Rocky Mountains of the western United States. In such an operation, a series of sliding sleeves are cemented thru as part of the well completion process. A problem with these systems is that cement can get into the inner workings of the sliding sleeves, which can cause problems with operation of the sleeves.

Prior art solutions to this problem have included putting grease into the sleeves to exclude the cement from the inner workings of the sleeve. However, the grease may still be displaced, for example, while the sliding sleeve is being run in or during other operations prior to cementing. Historically, there has been no solution to this problem other than to putting in what was thought to be a sufficient amount of grease and hoping for the best. Therefore, what is needed in the art is a system for preventing the displacement of grease disposed within a sliding sleeve to prevent entry of cement and/or other debris that can interfere with operation of the sliding sleeve.

SUMMARY

A variety of sliding sleeve mechanisms are disclosed herein. In some embodiments, the sliding sleeves include an outer housing with one or more flow ports and a sleeve mechanism disposed and longitudinally moveable within the outer housing. Aligning the sleeve mechanism relative to the flow ports of the outer housing can either permit or prevent fluid flow. The sliding sleeve can also include an easily destructible protective sheath that can provide debris protection by substantially blocking one or more of the flow ports.

The protective sheath can be formed from a variety of materials, such as composites, metal, foil, rubber, plastic, glass, ceramic, wire mesh, tape, etc. In some embodiments, the protective sheath can be a substantially cylindrical shell, which can be one or multiple pieces. The protective sheath can be retained in various ways, including, for example, recesses in the sliding sleeve or by mechanical fasteners such as screws, pins, rivets, snap rings, bands, and buckles. The protective sheath can also be disposed outside of the sliding sleeve (i.e., around the outer housing) or inside the sliding sleeve between the sleeve mechanism and the outer housing).

In other embodiments, the protective sheath can be in the form of plugs disposed within the one or more flow ports. The plugs can be separate plugs formed, for example, from one or more of the materials described above. Alternatively, the plugs can be integral with the outer housing and/or the sleeve mechanism formed by perforations. In still other embodiments the protective sheath can be from tape or wire wound around the sliding sleeve.

The protective sheath can protect the sliding sleeve from debris either by retaining grease that has been packed into the sliding sleeve for that purpose. Alternatively, the protective sheath can positively prevent entry of debris into the sliding sleeve. The sheath can be cleared by permitting fluid flow through the sliding sleeve, which can act to destroy and/or wash away the protective sheath.

Additional details and information regarding the disclosed subject matter can be found in the following description and drawings.

DETAILED DESCRIPTION

In the disclosure that follows, in the interest of clarity, not all features of actual implementations are described. It will of course be appreciated that in the development of any such actual implementation, as in any such project, numerous engineering and technical decisions must be made to achieve the developers' specific goals and sub goals (e.g., compliance with system and technical constraints), which will vary from one implementation to another. Moreover, attention will necessarily be paid to proper engineering and programming practices for the environment in question. It will be appreciated that such a development effort might be complex and time-consuming, but would nevertheless be a routine undertaking for those of ordinary skill in the relevant fields.

Figure 1:
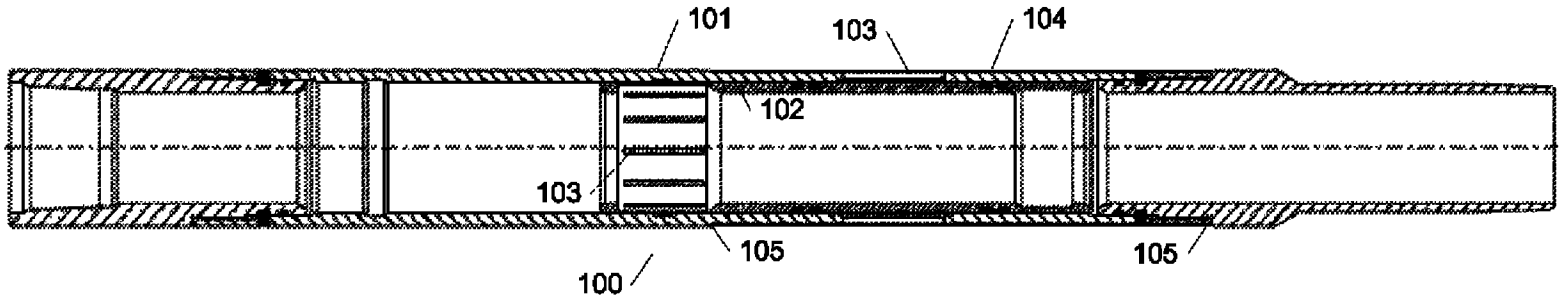
FIG. 1 illustrates a sliding sleeve with a protective sheath.

An exemplary sliding sleeve 100 is illustrated in FIG. 1. Sliding sleeve 100 includes an outer housing 101 and a sleeve mechanism 102 disposed therein. A plurality of flow ports 103 are disposed in the housing 101 and the sleeve mechanism 102. (It will be appreciated by those skilled in the art that the flow ports in sleeve mechanism 102 are not strictly necessary, depending on the design of the sliding sleeve.) As noted above, the sliding sleeve may be opened by moving sleeve mechanism 102 longitudinally within housing 101 to align flow ports 103. Similarly, the sliding sleeve may be closed by moving sleeve mechanism 102 longitudinally within housing 101 so that the flow ports 103 are not aligned (as shown). Exemplary sliding sleeve types include the OptiSleeve™ family of sliding sleeves available from Weatherford International Ltd., although other sliding sleeve types may also be used. The sleeve mechanism 102 may be moved by a variety of techniques. In some embodiments, operation of the sleeve may be hydraulic. In such applications, hydraulic shifting tools, such as the Hydraulic Weatherford B Shifting Tools, also available from Weatherford International Ltd., may be used to open and close the sliding sleeve.

As noted above, many completion operations can cause cement or other debris to enter flow ports 103 in the outer housing and interfere with operation of sliding sleeve 100. Grease within the tool has been used to prevent the entry of cement or other debris into the workings of sliding sleeve 100. Sliding sleeve 100 also includes protective sheath 104, which is disposed about the outer housing and retains the grease during run in or other operations. Protective sheath 104 may take a variety of forms. In one embodiment, protective sheath 104 can be a substantially cylindrical sheath disposed around sliding sleeve after the sleeve is packed with grease but before the sleeve is run in. It is not necessary for the sheath to form a tight seal, as grease can be retained within the workings of the sleeve with only minimal mechanical constraint. However, sheaths that do tightly seal may also be used. Depending on the specifics of the design, materials, etc., protective sheath 104 may have a thickness on the order of 30-50 thousandths of an inch, although other thicknesses could also be used.

Protective sheath 104 can be formed from a variety of materials. In some embodiments, the sheath will be removed after downhole installation by flow of fluid from within the sliding sleeve to outside the sliding sleeve. This can take place, for example, during a fracing operation. Thus, it may be desirable to form the sheath from an easily destructible material. For example, this could be a frangible or otherwise soft and/or brittle material that can be cleared by the flow of fluid through the flow ports. Examples of such materials include composite materials like those used in composite bridge plugs, thin metals, foils, rubber, plastic, glass, ceramics, etc. Alternatively, in some embodiments chemical reaction with the supplied fluid may be used to remove protective sheath 104. For example, sleeves that will be used in conjunction with acid fracing operations could use aluminum for protective sheath 104.

Figure 2:
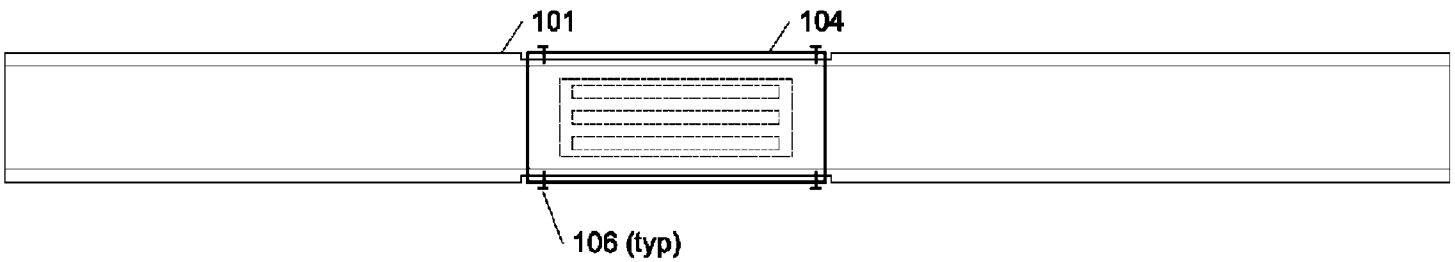
FIG. 2 illustrates a sliding sleeve with a protective sheath retained by set screws.

Protective sheaths may be used with existing sleeves with little or no modification. For example, as illustrated in FIG. 1, outer housing 101 has a recess (demarked by its endpoints 105) machined therein into which protective sheath 104 fits. In another embodiment, illustrated diagrammatically in FIG. 2, protective sheath 104 and outer housing 101 can be drilled so that set screws 106 can be used to retain the protective sheath. As an alternative to set screws, pins, rivets, etc. could also be used. In still other embodiments, snap rings or other mechanical fasteners could be used to retain protective sheath 104.

As an alternative to a single-piece, substantially cylindrical sheath, the protective sheath could be formed from multiple semi-cylindrical segments that are affixed together or affixed to the tool. For example, two half-cylinders could be placed around the sliding sleeve and attached to each other and/or to the sliding sleeve using a variety of mechanisms, including mechanical fasteners such as metal or plastic bands, adhesives, tapes, screws, buckles, etc. In another variation, the protective sheath could be formed from a fine wire mesh or similar material that would retain the grease, but be easily cleared by the flow of fluid through the sliding sleeve. In still another variation, the protective sheath could be formed from tape (such as duct tape, metalized tape, etc.) or wire wound around the outer housing.

Figure 3:
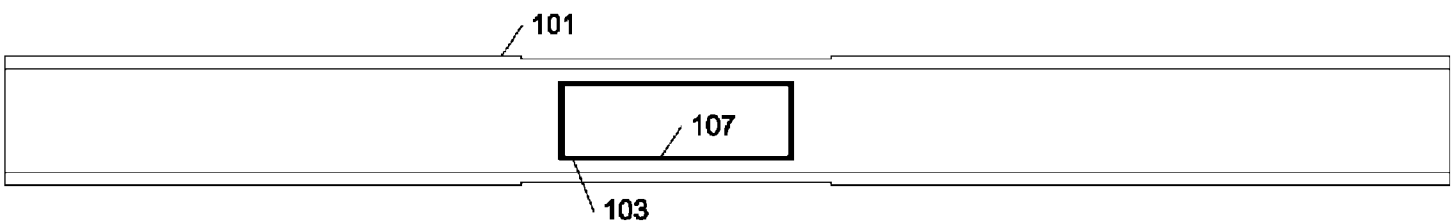
FIG. 3 illustrates a sliding sleeve in which the protective sheath takes the form of a plug disposed within the flow ports of the outer housing.

As illustrated diagrammatically in FIG. 3, rather than a protective sheath, flow ports 103 in outer housing 101 could be plugged with protective plugs 107. Protective plugs 107 can be formed from a variety of materials. Such materials can include any of the sheath materials described above, such as composites, metals, foils, rubber, plastic, glass, ceramics, etc. The plugs can be held in place by various techniques, including, for example, interference fit, snap rings, various fasteners, etc. Protective plugs 107 could also be formed by perforating but not completely opening flow ports 103 during fabrication of the sliding sleeve. Once the sliding sleeve was in place down hole and cementation or other debris-causing operations were completed, the pressure of fluid supplied or perforating charges could be used to clear the plug. Fabrication techniques required would be generally known to those skilled in the art, and are illustrated, for example, in U.S. Pat. No. 5,660,232, which is incorporated by reference herein.

Figure 4:
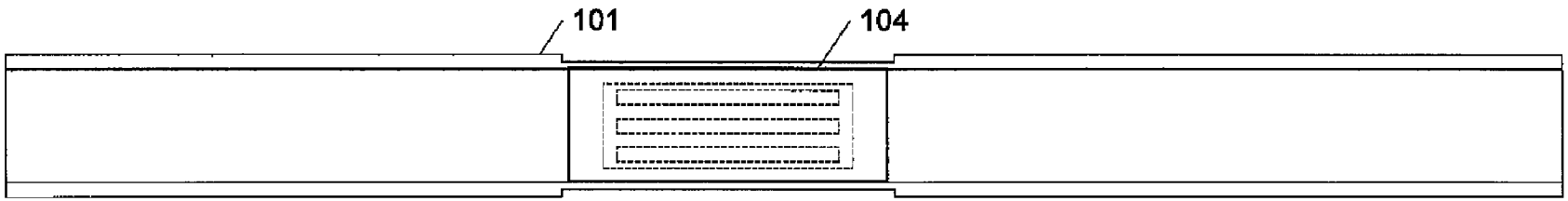
FIG. 4 illustrates a sliding sleeve with a protective sheath disposed between the inner sleeve mechanism and the outer housing.

In each of the foregoing embodiments, the protective sheath or plug has been disposed outside the sliding sleeve or within the flow ports or the outer housing. However, the device could also be constructed in other configurations. For example, as illustrated in FIG. 4, devices could be constructed with a sheath 104 between the sleeve mechanism and the interior of the outer housing 101. For embodiments using plugs, whether integral or separate, the plugs could also be disposed within the flow ports of the sleeve mechanism.

Although specific embodiments and variations of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations that may have been suggested in the present disclosure, may be made to the disclosed embodiments without departing from the scope of the invention as defined by the appended claims. For example, although described in terms of retaining grease within the sliding sleeve, the protective sheath could also be adapted to prevent entry of debris into the sliding sleeve. The foregoing description and drawings are, accordingly, to be regarded in an illustrative rather than a restrictive sense.

The invention claimed is:

1. A sliding sleeve comprising:

an outer housing having one or more flow ports therethrough;

a sleeve mechanism disposed and longitudinally moveable within the outer housing, wherein the sleeve mechanism may be aligned relative to the one or more flow ports in the outer housing to permit fluid flow; and a protective sheath disposed around the outer housing blocking one or more of the flow ports, wherein the protective sheath is easily destructible by flow of fluid from within the sliding sleeve to outside the sliding sleeve.

2. The sliding sleeve of claim 1 wherein the protective sheath comprises one or more materials selected from the group consisting of: a composite material, metal, foil, rubber, plastic, glass, ceramic, wire mesh, or tape.

3. The sliding sleeve of claim 1 or 2 wherein the protective sheath comprises a substantially cylindrical shell.

4. The sliding sleeve of claim 3 wherein the substantially cylindrical shell comprises a plurality of pieces.

5. The sliding sleeve of claim 3 further comprising one or more recesses in the outer housing adapted to retain the protective sheath.

6. The sliding sleeve of claim 3 further comprising one or more mechanical fasteners to retain the protective sheath.

7. The sliding sleeve of claim 6 wherein the one or more mechanical fasteners are selected from the group consisting of: screws, pins, rivets, snap rings, bands, and buckles.

8. The sliding sleeve of claim 1 wherein the protective sheath comprises tape wound around the outer housing.

9. The sliding sleeve of claim 1 wherein the protective sheath comprises wire wound around the outer housing.

10. A method of protecting a sliding sleeve from debris, the sliding sleeve comprising an outer housing having one or more flow ports therethrough and a sleeve mechanism disposed and longitudinally moveable within the outer housing such that the sleeve mechanism may be aligned relative to the one or more flow ports in the outer housing to permit fluid flow, the method comprising:

disposing a protective sheath around the outer housing of the sliding sleeve to block the one or more flow ports, wherein the protective sheath is easily destructible by flow of fluid from within the sliding sleeve to outside the sliding sleeve.

11. The method of claim 10 further comprising:

clearing the protective sheath by permitting fluid flow through the sliding sleeve.

12. The method of claim 10 or 11 wherein the protective sheath retains grease packed into the sliding sleeve.

13. The method of claim 10 or 11 wherein the protective sheath prevents entry of debris into the sliding sleeve.

* * * * *